United States Patent [19]

Bräuninger et al.

[11] Patent Number: 4,739,309

[45] Date of Patent: Apr. 19, 1988

[54] METHOD AND SYSTEM FOR INDICATING AND DISPLAY INFORMATION IN RESPONSE TO ELECTRICAL SIGNALS

[75] Inventors: Jürgen Bräuninger, Stuttgart; Rainer Rudolph, Leonberg, both of Fed. Rep. of Germany

[73] Assignee: Robert Bosch GmbH, Stuttgart, Fed. Rep. of Germany

[21] Appl. No.: 839,423

[22] Filed: Mar. 13, 1986

[30] Foreign Application Priority Data

Apr. 2, 1985 [DE] Fed. Rep. of Germany ..... 3511968

[51] Int. Cl.[4] ..... G08B 1/08

[52] U.S. Cl. ..... 340/534; 340/52 F; 340/538

[58] Field of Search ..... 340/52 F, 52 R, 53, 340/79, 85, 521, 531, 533, 534, 538, 825.16, 825.17, 825.36, 825.44; 307/10 R, 10 LS

[56] References Cited

U.S. PATENT DOCUMENTS

| | | | |
|---|---|---|---|
| 3,872,424 | 3/1975 | Enabnit | 340/52 F |
| 4,053,868 | 10/1977 | Cox et al. | 340/52 F |
| 4,344,076 | 8/1982 | Lewis | 340/825.17 |
| 4,463,341 | 7/1984 | Iwasaki | 340/52 F |
| 4,594,572 | 6/1986 | Haubner et al. | 340/52 F |

*Primary Examiner*—Joseph A. Orsino
*Assistant Examiner*—Brian R. Tumm
*Attorney, Agent, or Firm*—Frishauf, Holtz, Goodman & Woodward

[57] ABSTRACT

To permit connecting a display characterizing a malfunction, for example malfunction in an automotive vehicle, or another monitored apparatus, and a warning lamp to alert an operator that a malfunction is being indicated to a single connecting line (SL), a coded representation characterizing the malfunction in the form of short pulses (I; 1, 2) is transmitted on the same line, with pulses which are so short that the response inertia of the warning lamp does not perceptively change its brightness (or darkness) level, as controlled by the operating voltage of the warning lamp between a high and a low value. The coded pulse representation is decoded in a microprocessor (MP) and displayed on a display (A) forming part of an evaluation device, coupled to the same single communication line (SL) which may be a single wire with chassis or ground return, or a two-wire connection. Typically, the warning lamp may operate in one to several second intervals (for example flashing), the pulses having pulse duration in the millisecond or fractional millisecond range. The pulses, when the warning signal lamp voltage level is "high" then are formed by "low" value pulses, and, if the lamp is dark, so that the operating signal is "low", the pulses are "high" and of insufficient duration to cause lighting of the lamp filament.

21 Claims, 1 Drawing Sheet

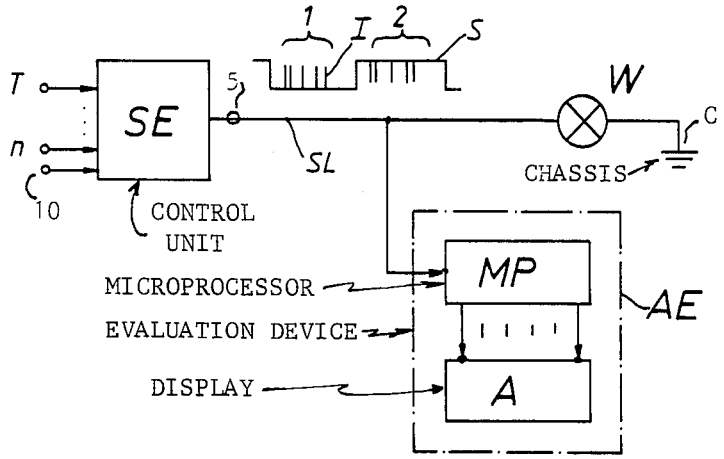
1
I
2
S
T
n
10
SE
5
SL
W
C
CHASSIS
CONTROL UNIT
MICROPROCESSOR
EVALUATION DEVICE
DISPLAY
MP
A
AE

METHOD AND SYSTEM FOR INDICATING AND DISPLAY INFORMATION IN RESPONSE TO ELECTRICAL SIGNALS

The present invention relates to a method and system for indicating that a certain electrical signal, typically a malfunction signal, is present, and to display the nature of the malfunction, while using only a single communication line or circuit.

BACKGROUND

Malfunction of apparatus, and particularly in vehicles, for example malfunction within an engine or operating control system of an automotive vehicle, is frequently indicated by a warning lamp. Such a warning lamp may, for example, be used to indicate a simple malfunction. Such warning lamps can be controlled in a different manner, for example by lighting as soon as a malfunction is detected or, if the malfunction is serious, intermittently flashing. Thus, a single warning lamp may provide differential output to characterize two different conditions.

Continuous illumination may be used to indicate a simple malfunction. This requires a continuous control signal, for example a "high voltage level" at a connecting line to a warning lamp. If the lamp flashes, however, a malfunction of a specific type may be indicated thereby.

It would, of course, be possible to associate individual warning lamps with different causes for malfunction. It is, however, equally possible to provide a single warning lamp which may be either continuously illuminated or be intermittently illuminated, that is, to flash, and in addition to provide a display on which the type of malfunction is displayed. The warning lamp, thus, alerts the operator to read the display. The display itself may be coupled to a diagnostic apparatus for precise indication, by alphanumeric or symbolic representation, of the particular type of malfunction of message to be conveyed to the operator.

Controlling a diagnostic display apparatus, heretofore, has required a plurality of connecting lines. Furthermore, the warning lamp requires a connecting line. The additional connecting lines and the plurality of wires are, again, subject to malfunction, require additional material and installation and, further, require separate outputs to the respective warning lamps or display elements. Commercial circuit arrangements for monitoring or testing of apparatus elements or continuous operating sequences carried out by machinery frequently have only few output terminals. Providing additional diagnostic apparatus to be coupled to the few output terminals makes the circuit requirements for the test and monitoring circuit complex and expensive. Entirely apart from the expense, the increased complexity again may be a source of malfunction.

THE INVENTION

It is an object to reduce the number of connecting lines between a warning lamp and a display indicating, for example, a type of malfunction, and more particularly to provide a method and system in which a warning lamp can be energized while, at the same time, data or information signals, typically error information signals, in coded form, are being transmitted to the display.

Briefly, the warning lamp is operated based on signals which have, selectively, a high voltage level or a low voltage level, depending upon whether the lamp is to be illuminated or extinguished. The high and low voltage levels may follow each other in repetitive sequence to provide for flashing of the lamp. These high and low voltage levels can be transmitted over a single wire with ground or chassis return or over a two-wire line to two filament terminals of the lamp. Simultaneously, the connecting line to the lamp has applied thereto control data or information signals in coded form which are formed as short pulses. The duration of the pulses of the control data or information signals are so short that the human eye cannot perceive any variation in the brightness level of the lamp—either when it is lit, or when it is dark—in other words, the pulses are not long enough to cause the lamp to light if it is controlled to be dark. The pulses, thus, will be so short that the response inertia or delay of the lamp is substantially longer than the duration of the pulses Conversion of electrical applied energy to light output, or change in light output of the lamp, will not occur due to the thermal or optical inertia of the lamp filament. The coded data or information signals, however, can be detected by a decoder, or other code evaluation circuit, for conversion to suitable output signals, for example to illuminate a liquid-crystal display (LCD) or another suitable display, as well known.

The system and method has the advantage that only a single control apparatus is necessary to control a customary warning lamp, as well as to transmit coded data or information signals, for example display control signals, all over a single wire or a single pair of wires. The signal to control the warning lamp and to transmit the error or malfunction code are applied to the connecting line, superimposed and modulated on each other. The code is formed by signals of such short pulses that response to the pulses by the warning lamp will be insufficient for perception by the human eye. Thus, the warning lamp may be used, as desired, to be continuously illuminated in one form of operation, or to flash in another form. It is possible, in either operating mode of the warning lamp, to provide, in periodic sequences, pulses for precise characterization of the particular malfunction to which an operator is to be alerted. An evaluation circuit, which might also be termed a diagnostic circuit, can be used to evaluate the pulse trains and to provide suitable output signals in accordance with the evaluation, for example by providing alphanumeric control signals to an LCD. The error or malfunction may, of course, also be indicated by a different type of lamp or light emitting diode (LED), for example associated with specific display or symbols, or by illuminating a given number on a prenumbered panel. Of course, it is equally possible to store the pulses characterizing a particular malfunction in a memory which is interrogated, either under operator control, after elapse of time, or under control of suitable interrogation pulses.

In accordance with a preferred embodiment of the invention, the pulses which control the indicator have an inverse polarity with respect to the operating signals for the warning lamp. Thus, if the warning lamp is to light, the warning lamp is subjected to a high voltage level, and the pulses will form negative voltages with respect thereto, for example by, very rapidly, in pulse form, dropping the lamp voltage to zero. The pulses are so short that the lamp remains lit, and the interruption in supply voltage to the lamp by the negative-going pulses, cannot be perceived by the human eye. This has the advantage that the overall operating voltage level of the lamp need not be changed, and thus special precautions to prevent overvoltages from occurring within the circuit are not needed.

In accordance with a feature of the invention, the blocks of pulses and representing data characterizing certain malfunctions can be transmitted several times per second in the form of pulse trains. The evaluation circuit can recognize the beginning and end, for example, of the blocks or trains of the pulses if, for example, in accordance with another preferred feature of the invention, a recognition group of pulses formed, for example, by two pulses which may have a predetermined time relation with respect to their sequence, is transmitted to form a recognition signal.

In accordance with a feature of the invention, the circuit includes a control element which provides the necessary energization signals for the warning lamp as well as the pulse signals to control the evaluation circuitry. The evaluation circuitry may, for example, include a microprocessor of commercial type and a display which, then, will indicate the respective malfunction about which the operator is to be alerted.

DRAWING

The single FIGURE, highly schematically, illustrates in block circuit diagram form, the system of the present invention, on the basis of which the method will also be explained.

DETAILED DESCRIPTION

Unit SE receives various types of inputs, for example a temperature signal T, a speed signal n, and other signals collectively indicated by terminal 10 which are representative of operating parameters or conditions occurring in a controlled and/or monitored and supervised apparatus, for example an internal combustion engine or auxiliary apparatus used with and in a motor vehicle. As well known, if engine temperature in the motor vehicle exceeds a given level, for example as measured by a thermostat coupled to the engine block or to a cooling water reservoir, an indication or warning output should be given. The control unit SE, for example, compares the input signals representative of the various conditions, for example temperature, speed and the like, with respective reference values, and, if the reference is exceeded, provides a warning output signal. The warning output signal is available at a terminal 5.

In accordance with a feature of the invention, a single connecting control line SL is coupled to the single output terminal 5. The line SL, which may be a two-wire line or a single-wire line, is connected to a warning lamp W. If a single-wire is used, the return path to a power source is through ground or chassis C, for example the chassis of the motor vehicle. In accordance with a feature of the invention, the control line SL is further connected to the input of a microprocessor MP which, at the output thereof, is connected to a display unit A. The microprocessor AE and the display unit A, together, form an evaluation device or system AE.

OPERATION

The output terminal 5 of the control unit SE will have a control signal S appear thereon if, for example, a certain threshold is exceeded. The control signal S varies between a low voltage value and a high voltage value. The warning lamp W, thus, will be energized in pulses and will give a flashing indication. In accordance with a feature of the invention, the control signal S has modulated thereon, or superimposed thereon, a plurality of pulses I, which, in coded form provide data representing the particular information to be transmitted from unit SE to the evaluation device AE and to be displayed in the display unit. Let it be assumed that the temperature level in the engine has risen above a safe value. The output terminal 5 then will have appear thereat the signal S, causing the lamp W to blink and, further, a coded sequence of pulses, or a pulse train which is decoded in the microprocessor MP to provide on the display A a legible output which, for example, may say "temperature high".

For simplicity, only two blocks or trains of pulses 1, 2 are shown, in highly simplified form. In actual operation, the pulse groups or pulse trains may have time gaps of 1 ms from each other. The signal S, which energizes the warning lamp W, may change its voltage level, however, only every 1 to 2 seconds.

The pulses I, modulated or superimposed on the signals S, are also applied to the warning lamp W. The human eye, however, cannot perceive fast variation in brightness—or a change from complete darkness—of the lamp W. Thus, the very rapid pulses I cannot be humanly perceived. The pulse duration of the pulses I may, for example, be 0.5 milliseconds. Such short pulses are not converted by the lamp W into light pulses, nor can such short pulses be perceived as variation in light intensity when the level at the lamp W of the signal S is "high" or cause the lamp to be even slightly illuminated when the lamp should be dark, that is, the signal level S is "low". The lamp W, typically, is an incandescent lamp, and the inertia of the filament, that is, the transfer characteristics of electrical energy into light of such lamps is so slow that data pulses, typically of the pulse duration of 0.5 milliseconds, or in the order of milliseconds, cannot be perceived.

To permit the microprocessor MP to recognize the beginning of a pulse train or pulse block which characterizes information, for example information to be displayed by the display A, two pulses, for example of predetermined time duration and/or time spacing, are transmitted, thereby indicating that the subsequent variations in the signal level from data pulses. The respective signals 1 and 2 of the pulses I show the initial two-pulse recognition sequence of two pulses.

A suitable microprocessor MP, for example capable of recognizing a group of coded signals and providing a predetermined alphanumeric or symbolic output at an LCD A is:

The signal level S may change, for example, between 0 (low) and nominally 12 (high) volts. The polarity of the signals 1, 2 changes so that, when the signal S is low, the pulses will be high; when the signal is high, the pulses will be low. The level of the pulses need not extend the entire voltage range between "high" and "low" for the lamp W, but may be less. It should not be more, however, to avoid occurrence of any overvoltage conditions.

We claim:

1. A method for combined single-line multiplex control of a warning lamp (W) and transmission of coded information signals (1, 2), comprising the steps of providing a warning lamp (W) which has a predetermined response time inertia with respect to change of illumination upon change of energization of the lamp;

selectively energizing or de-energizing said lamp (W) by application, on a single line (SL) having two conductors, of an operating signal (S) having, selectively, a high voltage level or a low voltage level, and being of a duration in excess of said predetermined response time, to cause the lamp to assume, selectively, a state of being lit or extinguished;

generating coded display information signals (1, 2) which form coded control signals characterizing by a code specific indicia to be displayed, said coded display information signals comprising short pulses (I) of a duration which is shorter than the repsonse inertia of the warning lamp (W) in converting electrically applied energy to light output or in changing light output in response to change of applied electrical energy and shorter than the perception threshold of the human eye; and selectively applying said coded display information signals (1, 2) to said single line (SL) to permit decoding of the coded display information signals and retrieval of information represented thereby by electrical connection to said single line (SL).

2. The method of claim 1, wherein the lamp is an incandescent lamp and said pulses have a duration of approximately 0.5 millisecond.

3. A method for combined single-line multiplex control of a warning lamp (W) and transmission of coded information signals (1, 2), comprising the steps of providing a warning lamp (W) which has a predetermined response time inertia with respect to change of illumination upon change of energization of the lamp;

selectively energizing or de-energizing said lamp (W) by application, on a single line (SL) having two conductors, of an operating signal (S) having, selectively, a high voltage level or a low voltage level, and being of a duration in excess of said predetermined response time, to cause the lamp to assume, selectively, a state of being lit or extinguished;

generating coded display information signals (1, 2) which comprise short pulses (I) of a duration which is shorter than the response inertia of the warning lamp (W) in converting electrically applied energy to light output or in changing light output in response to change of applied electrical energy and shorter than the perception threshold of the human eye; and selectively applying said coded display information signals (1, 2) to said single line (SL) to permit decoding of the coded display information signals and retrieval of information represented thereby by electrical connection to said single line (SL);

wherein the pulses have a voltage level which is high when the operating signal (S) has a voltage level which is low;

and wherein the pulses have a voltage level which is low when the operating signal (S) has a voltage level which is high.

4. The method of claim 3, wherein the lamp is an incandescent lamp and said pulses have a duration of approximately 0.5 millisecond.

5. A method for combined single-line multiplex control of a warning lamp (W) and transmission of coded information signals (1, 2), comprising the steps of providing a warning lamp (W) which has a predetermined response time inertia with respect to change of illumination upon change of energization of the lamp;

selectively energizing or de-energizing said lamp (W) by application, on a single line (SL) having two conductors, of an operating signal (S) having, selectively, a high voltage level or a low voltage level, and being of a duration in excess of said predetermined response time, to cause the lamp to assume, selectively, a state of being lit or extinguished;

generating coded display information signals (1, 2) which comprise short pulses (I) of a duration which is shorter than the response inertia of the warning lamp (W) in converting electrically applied energy to light output or in changing light output in response to change of applied electrical energy and shorter than the perception threshold of the human eye; and selectively applying said coded display information signals (1, 2) to said single line (SL) to permit decoding of the coded display information signals and retrieval of information represented thereby by electrical connection to said single line (SL); wherein the pulses (I) comprise periodically recurring repetitive groups or sets or blocks of pulses (1, 2);

the sets or groups or blocks of pulses (I) include a coded pulse sequence or subgroup characterizing the pulses and distinguishing the pulses from said operating signal (S); and wherein the sets or groups or blocks of pulses (I), at their initial occurrence, include said characterizing subgroups;

wherein the pulses of the sets or groups or blocks of pulses other than the characterizing subgroups are transmitted in accordance with a fixed clock rate or at fixed time durations or gaps, the time distribution of occurrence of the pulses characterizing specific information contents of said control signal; and further including the step of applying said pulses, in coded form, to a code evaluation and display device (AE; MP, A).

6. Method according to claim 5, wherein the sets or groups or blocks of pulses (I) are transmitted several times per second.

7. The method of claim 5, wherein the lamp is an incandescent lamp and said pulses have a duration of approximately 0.5 millisecond.

8. Method according to claim 5, wherein said coded information signals comprise coded display control signals characterizing, by a code, specific indicia to be displayed.

9. Method according to claim 5, wherein said information contents comprise information representative of malfunction of an apparatus or device or system.

10. Method according to claim 5, wherein the characterizing subgroups comprise two pulses transmitted in a predetermined time sequence.

11. In a warning system, a method of alerting an operator to a condition occurring in a system or apparatus or device and indicating the nature of the condition, comprising the steps of generating warning lamp operating signals (S) having, selectively, a high voltage level and a low voltage level to cause a warning lamp (W) to, selectively, be illuminated or remain dark, said warning lamp operating signals having a duration which exceeds the response inertia of the lamp to change in voltage level being applied thereto;

*generating, in coded form, a code sequence of condition information or data signals, representative of, and characterizing a specific condition, and comprising groups or sets or blocks of pulses (I; 1, 2) which have a time duration which is short with respect to the response inertia of the warning lamp (W);* connecting both said lamp operating signals (S) as well as said information or data signals (1, 2) on a single, two-conductor communication line (SL) and selectively energizing, or leaving unenergized, said warning lamp (W) from said communication line;

decoding the information content of the data or information signals by connecting a decoding evaluation circuit (AE) to said single communcation line to permit displaying the nature of the condition based on the decoded data or information signals; and wherein said coded condition information or data signals have a voltage level which is high when the voltage level of the operating signals (S) for the warning lamp is low, and said condition information or data signals have a voltage level which is low when the voltage level of the operating signals (S) for the warning lamp is high.

12. The method of claim 11, wherein the lamp is an incandescent lamp and said pulses have a duration of approximately 0.5 milisecond.

13. Method according to claim 11, wherein the voltage level of said coded information or data signals is at the most up to, but does not exceed the difference in voltage levels between high voltage level and low voltage level of the operating signal (S).

14. Method according to claim 11, wherein the sets or groups or blocks of pulses (I; 1, 2) include, at the beginning portion thereof, a sequence of pulses forming a pulse recognition code.

15. Method according to claim 14, wherein the coded information or data signals are applied to said single communication line in form of a time or clock code.

16. Method according to claim 11, wherein the time of change of the operating signal, selectively, between high voltage level and low voltage level is in the order of from one to several seconds;

and the pulsed, coded information or data signals (I; 1, 2) comprise energy pulses having a time duration in the order of milliseconds or fractions thereof.

17. System to provide a warning indication output to an operator, by operation of a warning lamp, and providing a condition message on a display (A) characterizing a condition of a monitored apparatus or system, comprising a warning lamp (W) having a predetermined response time inertia with respect to change of illumination upon change of energization of the lamp;

*a control unit (SE) including an output terminal (5) thereof, providing*

(a) an operating signal (S) for the warning lamp (W) comprising, selectively, a high voltage level with sufficient energy for illuminating the warning lamp or a low voltage level at which the lamp is extinguished, said operating signals having a time duration in excess of said response inertia, and (b) coded information or data signals (I) for the display, said coded information or data signals comprising pulses of a time duration which is short with respect to the response inertia of the lamp;

a single two-conductor connecting circuit (SL) connected to said output terminal (5) and to said warning lamp, and having applied thereto the operating signal for the warning lamp and said coded information and data signals (I); and means coupled to said single connecting circuit (SL) for decoding the information content of said information or data signals (I; 1, 2) applied to said output terminal (5) and to said single connecting circuit (SL), said pulses forming the information or data signals being of insufficient electrical energy to convert the energy to light output of the warning lamp (W), or changing light output and being substantially below the inertia of human perception to any change in the lit or, selectively, extinguished condition of the lamp.

18. System according to claim 17, wherein the means for decoding comprises a microprocessor (MP) decoding the respective coded information and data signals, and being connected to and controlling the display (A) for indicating the nature of a condition, as represented by the code of the information and data signals applied to said single communication line (SL).

19. System according to claim 17, wherein the control unit furnishes said information and data signals in the form of said short pulses which, when the operating signal (S) for the warning lamp has a high voltage level, is at a low voltage level; and, when the operating signal for the warning lamp (W) is at a low voltage level, provides said coded information and data signals at a high voltage level.

20. The system of claim of claim 17, wherein the lamp is an incandescent lamp and said pulses have a duration of approximately 0.5 millisecond.

21. System according to claim 17, wherein said information or data signals comprise coded display control signals which characterize, by a code, specific indicia to be displayed on said display (A).

* * * * *